US005642720A

United States Patent [19]

Kim

[11] Patent Number: 5,642,720

[45] Date of Patent: Jul. 1, 1997

[54] STRUCTURE FOR GUIDING FUEL EVAPORATION GAS IN CANISTER FOR AUTOMOBILES

[75] Inventor: Wan Tae Kim, Seoul, Rep. of Korea

[73] Assignee: Kia Motors Corporation, Seoul, Rep. of Korea

[21] Appl. No.: 679,561

[22] Filed: Jul. 15, 1996

[30] Foreign Application Priority Data

Jun. 14, 1996 [KR] Rep. of Korea ..... 1996-15819

[51] Int. Cl.[6] ..... F02M 25/08

[52] U.S. Cl. ..... 123/518

[58] Field of Search ..... 123/516, 518, 123/519, 520, 521

[56] References Cited

U.S. PATENT DOCUMENTS

| | | | |
|---|---|---|---|
| 4,044,743 | 8/1977 | Eaton | 123/520 |
| 4,112,898 | 9/1978 | Takimoto et al. | 123/521 |
| 4,403,587 | 9/1983 | Mizuno et al. | 123/519 |
| 4,853,009 | 8/1989 | Turner et al. | 123/519 |
| 5,253,629 | 10/1993 | Fornuto et al. | 123/519 |
| 5,545,849 | 8/1996 | Mizuno et al. | 123/519 |
| 5,562,083 | 10/1996 | Osanai | 123/520 |

*Primary Examiner*—Thomas N. Moulis

[57] ABSTRACT

A structure for guiding fuel evaporation gases in a canister for automobiles is disclosed. The gas guide structure in the canister of this invention is free from a partition, which has been typically arranged in the upper section inside the upper case of the canister, but has a mounting nipple which is provided on the top center of the upper case. An evaporation gas guide unit is tightly fitted into the mounting nipple. The gas guide unit comprises a nipple holder and fitting part which are preferably cast as a single structure. The nipple holder has the gas inlet and outlet nipples, while the fitting part is fitted into the mounting nipple in order to airtightly mount the unit to the canister. The structure appropriately controls flow of the evaporation gases inside the canister filled with active charcoal, thereby preventing quick failure of the charcoal and lengthening the expected life span of the canister, and improving the durability of an evaporation gas control device.

1 Claim, 3 Drawing Sheets

STRUCTURE FOR GUIDING FUEL EVAPORATION GAS IN CANISTER FOR AUTOMOBILES

BACKGROUND OF THE INVENTION

1. Field of the Invention

The present invention relates, in general, to a structure for guiding fuel evaporation gas in a canister of an automobile in order to prevent the evaporation gas from being exhausted into the atmosphere and, more particularly, to an improvement in such an evaporation gas guiding structure. The improved structure allows the evaporation gas to be directly guided toward the engine without passing through the active charcoal inside the canister while driving an automobile, thus effectively preventing quick failure of the charcoal and lengthening the expected life span of the canister.

2. Description of the Prior Art

As well known to those skilled in the art, an automobile generates several types of harmful gases, such as blow-by gases, exhaust gases and fuel evaporation gases, which may be exhausted into the atmosphere. In the above gases, the blow-by gases mean the mixture gases or unburnt gases which leak from the combustion chamber into the atmosphere through the crank case of the engine. The exhaust gases are generated during the engine operation and are exhausted into the atmosphere through the exhaust system of an automobile. The evaporation gases are generated by evaporation of fuel inside the fuel tank and are exhausted into the atmosphere through the injection port of the tank.

The above gases, generated in an automobile and exhausted into the atmosphere, include harmful materials such as carbon monoxide CO, nitrogen oxide NOx and hydrocarbon HC. In order to restrict exhaust of the above harmful gases, automobiles are typically provided with gas control devices.

Particularly, a canister has been typically used in an evaporation gas control device which is used for preventing the evaporation gases, which are generated by evaporation of fuel inside the fuel tank, from being exhausted into the atmosphere.

FIG. 1 shows the construction of a typical evaporation gas control device with a canister. As shown in the drawing, the evaporation gas control device includes a canister 20 which is connected between the fuel tank 10 and the suction manifold 30 of an engine. The above canister 20 is filled with active charcoal 21. The device also includes a purge control valve 40 which is installed on the top of the canister 20. In operation of the above evaporation gas control device, the pressurized evaporation gases inside the fuel tank 10 selectively open the purge control valve 40 and flows into the canister 20 when the evaporation gas pressure inside the tank 10 is higher than a given level. The purge control valve 40 is closed when the engine stops, so that the evaporation gases absorbed by the charcoal 21 are not guided into the suction manifold 30, but remain inside the canister 20. However, when the engine starts, the purge control valve 40 is opened by the negative pressure generated during the suction stroke in the engine. In the above state, the evaporation gases along with fresh air flow from the canister 20 into the suction manifold 30 and are thereby burnt in the engine. The above fresh air is sucked into the canister 20 through the air inlet nipple provided on the bottom of the canister 20.

The detailed construction of the typical canister is shown in FIGS. 2 and 3. As shown in the drawings, the canister 20' comprises a cylindrical upper case 22' which is filled with active charcoal 21' and opens to its bottom. The open bottom of the above upper case 22' is closed by a circular bottom cover 23'. Two evaporation gas nipples, that is, gas inlet and outlet nipples 24' and 25', extend upward from the top wall of the above upper case 22'. An air inlet nipple 26', through which fresh air flows into the canister 20', is provided on the center of the bottom cover 23'.

In the canister 20', a filter 29' and partition 28' are arranged horizontally and vertically in the upper section inside the upper case 22', respectively. A space is defined between the filter 29' and the bottom cover 23' and is filled with the charcoal 21'. The partition 28' extends downward from the center of the top wall in the upper case 22', thus partitioning the upper section inside the case 22' into two sections, that is, the gas inlet and outlet sections communicating with the gas inlet and outlet nipples 24' and 25'.

However, the above canister 20' has the following problems. That is, the evaporation gases from the fuel tank 10 flow into the canister 20' through the inlet nipple 24' and in turn necessarily pass through the charcoal 21' prior to being discharged from the canister 20' toward the suction manifold 30 through the outlet nipple 25'. The charcoal 21' is thus brought into quick failure, so that the expected life span of the canister 20' is shortened. Particularly, the operational performance of the canister 20' is reduced as the mileage of an automobile is increased. The canister 20' thus fails to effectively prevent the evaporation gases from being exhausted into the atmosphere.

SUMMARY OF THE INVENTION

It is, therefore, an objective of the present invention to provide a structure for guiding fuel evaporation gas in a canister for automobiles by which the above problems can be overcome and which appropriately controls flow of the evaporation gases inside the canister filled with active charcoal, thereby preventing quick failure of the charcoal and lengthening the expected life span of the canister, and improving the durability of an evaporation gas control device.

In order to accomplish the above objective, the canister according to this invention is free from the partition, which has been typically arranged in the upper section inside the upper case of the canister in order to divide the upper section into two parts, but has a mounting nipple. The mounting nipple is provided on the center of the top surface of the upper case. An evaporation gas guide unit is fitted into the mounting nipple. The above gas guide unit comprises a nipple holder and fitting part which are preferably cast as a single structure. The nipple holder has the gas inlet and outlet nipples for guiding the evaporation gases, while the fitting part is fitted into the mounting nipple of the upper case in order to airtightly mount the unit to the upper case.

BRIEF DESCRIPTION OF THE DRAWINGS

The above and other objectives, features and other advantages of the present invention will be more clearly understood from the following detailed description taken in conjunction with the accompanying drawings, in which.

DESCRIPTION OF THE PREFERRED EMBODIMENTS

Figure 1:
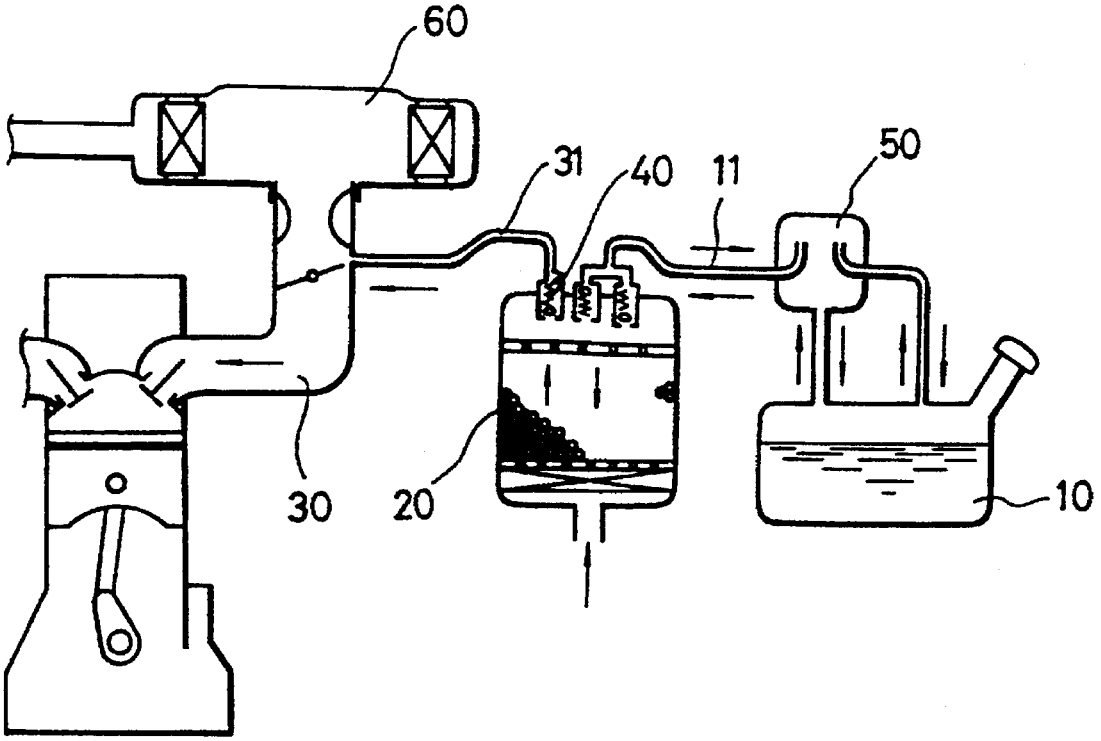
FIG. 1 PRIOR ART
FIG. 1 is a view showing the system for guiding the evaporation gases from a fuel tank to the suction manifold of an engine by way of a conventional canister.
Figure 2:
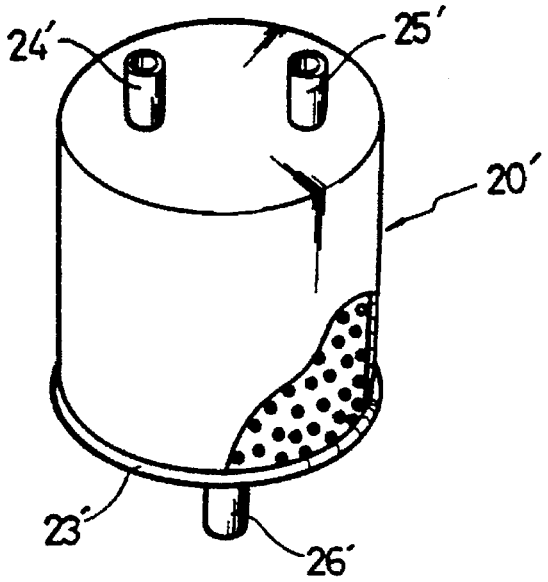
FIG. 2 PRIOR ART
FIG. 2 is a partially broken perspective view of a typical canister.
Figure 3:
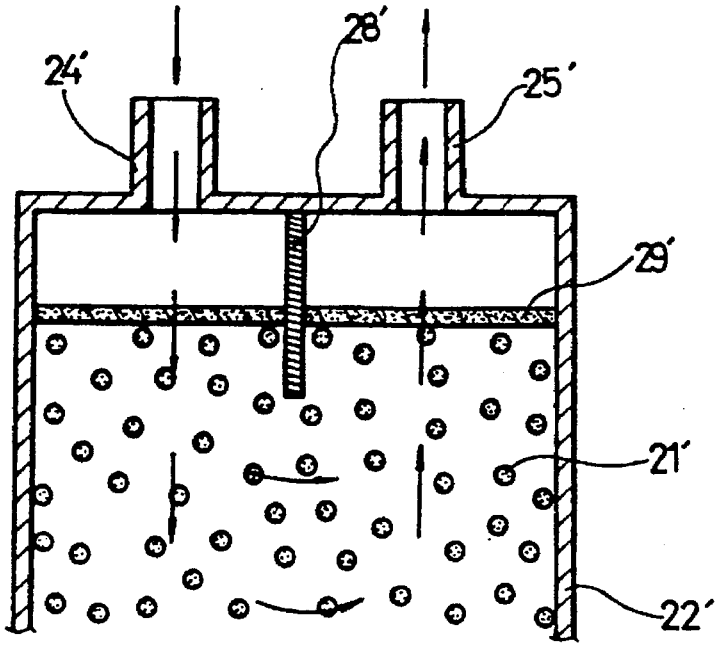
FIG. 3 PRIOR ART
FIG. 3 is a sectional view showing the construction of the typical canister of FIG. 2.
Figure 4:
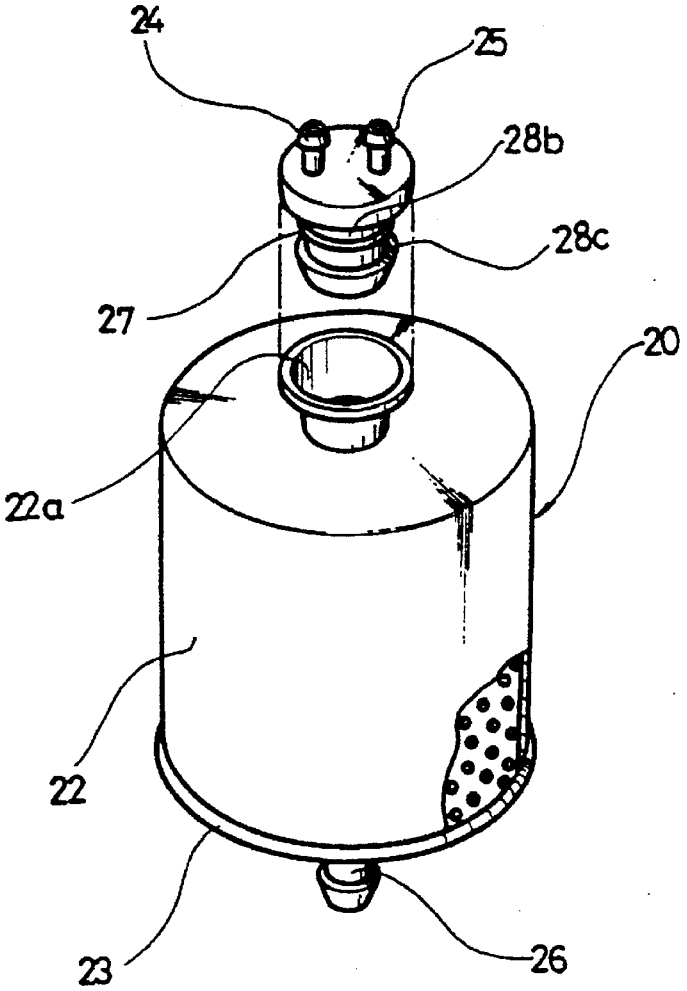
FIG. 4 is an exploded and partially broken perspective view of a canister in accordance with the preferred embodiment of the present invention.
Figure 5:
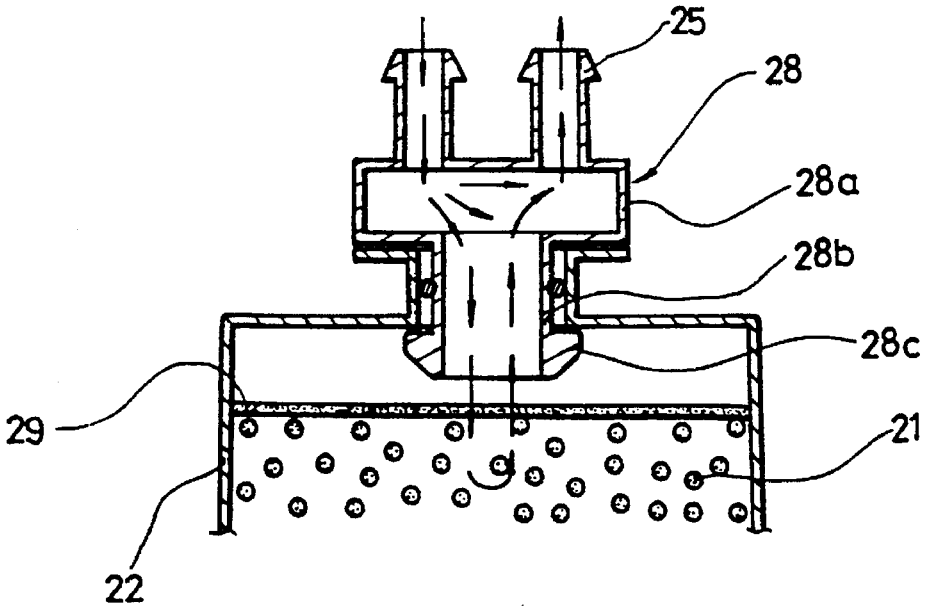
FIG. 5 is a sectional view showing the construction of the canister of FIG. 4.

FIGS. 4 and 5 show the construction of a canister in accordance with the preferred embodiment of the present invention. Most of the elements of the preferred embodiment of this invention are common with those of the prior embodiment of FIGS. 1 to 3. The elements common to both the embodiment of this invention and the prior embodiment will thus carry the same reference numerals. The description thereof is omitted.

As shown in FIGS. 4 and 5, the canister 20 of this invention comprises an upper case 22 and a bottom cover 23. The open bottom of the upper case 22 is closed by the bottom cover 23. A filter 29 is horizontally arranged in the upper section inside the upper case 22. A space is defined between the filter 29 and the bottom cover 23 and is filled with charcoal 21. An air inlet nipple 26, through which fresh air flows into the canister 20, is provided on the center of the bottom cover 23.

In accordance with the present invention, the canister 20 has a flanged mounting nipple 22*a* and an evaporation gas guide unit 28. The mounting nipple 22*a* is provided on the center of the top surface in the upper case 22, while the evaporation gas guide unit 28 is tightly fitted into the mounting nipple 22*a*. The gas guide unit 28 comprises two parts, that is, a nipple holder 28*a* and a fitting part 28*b*. In the present invention, it is preferred to cast the nipple holder 28*a* and fitting part 28*b* as a single structure. The nipple holder 28*a* has two nipples, that is, the gas inlet and outlet nipples 24 and 25, while the fitting part 28*b* is tightly fitted into the mounting nipple 22*a* of the upper case 22 in order to airtightly mount the unit 28 to the upper case 22. The inlet and outlet nipples 24 and 25 are connected to the fuel tank 10 and the suction manifold 30 of an engine through hoses 11 and 31, respectively. A purge control valve 40 is mounted to the hose 31 extending from the outlet nipple 25 to the suction manifold 30. The above valve 40 is controlled by an engine control unit (ECU, not shown) in a conventional manner.

In the above gas guide unit 28, the fitting part 28*b* has an outer diameter slightly larger than the inner diameter of the mounting nipple 22*a*, so that the unit 28 is airtightly fitted into the mounting nipple 22*a*. The lower end of the fitting part 28*b* is provided with stop flange 28*c*, which is caught by the inside shoulder of the mounting nipple 22*a* and is thereby locked to the nipple 22*a* when the fitting part 28*b* is fully inserted into the nipple 22*a*.

In the drawings, the reference numerals 27, 50 and 60 denotes a seal ring, a gas/liquid separator and an air cleaner, respectively.

The above gas guide unit 28 is mounted to the upper case 22 of the canister 20 by tightly fitting the fitting part 28*b* of the unit 28 into the mounting nipple 22*a* of the case 22. When the gas guide unit 28 is fully inserted into the mounting nipple 22*a*, the stop flange 28*c* of the unit 28 is caught by the inside shoulder of the mounting nipple 22*a* and is thereby locked to the nipple 22*a*. The unit 28 is thus not suddenly separated from the nipple 22*a*.

When an automobile is stopped or parked, the purge control valve 40 is closed under the control of the engine control unit (ECU), while the evaporation gases generated from the fuel tank 10 flow into the canister 20. In the canister 20 in the above state, the evaporation gases pass through the filter 29 and in turn are absorbed by the charcoal 21 inside the canister 20 as shown in FIG. 5. When the purge control valve 40 is opened under the control of the engine control unit as the engine starts to drive the automobile, the evaporation gases along with fresh air are discharged from the canister 20 through the outlet nipple 25 and flow into the suction manifold 30 of the engine. The evaporation gases along with fresh air are burnt in the combustion chamber of the engine, so that the evaporation gases are prevented from being exhausted into the atmosphere.

While the engine is operated, the evaporation gases, which flow into the nipple holder 28*a* of the unit 28 through the inlet nipple 24, are directly guided toward the outlet nipple 25 and thereby flows toward the suction manifold 30 of the engine. That is, the canister 20 of this invention passes the evaporation gases through the charcoal 21 exclusively when the engine is stopped, but allows the evaporation gases to directly flow toward the suction manifold 30 without passing through the charcoal 21 when the engine is operated.

As described above, the present invention provides a structure for guiding fuel evaporation gas in a canister for automobiles. When an engine is stopped while stopping or parking an automobile, the above guiding structure causes the fuel evaporation gases to pass through the active charcoal. However, when the engine is operated, the structure allows the evaporation gases to flow toward the suction chamber of an engine without passing through the charcoal inside the canister, thereby preventing quick failure of the charcoal and lengthening the expected life span of the canister, and remarkably improving the durability of an evaporation gas control device.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A structure for guiding fuel evaporation gas in a canister for automobiles, said canister comprising an upper case, a bottom cover closing an open bottom of said upper case, a filter horizontally arranged in an upper section inside said upper case, active charcoal filling a space defined between the filter and the bottom cover, and an air inlet nipple provided on the center of said bottom cover for allowing fresh air to flow into said canister, wherein the improvement comprises:

a mounting nipple provided on a top center of said upper case of the canister;

an evaporation gas guide unit fitted into said mounting nipple, said gas guide unit comprising:

a nipple holder provided with evaporation gas inlet and outlet nipples; and a fitting part fitted into said mounting nipple thereby mounting the gas guide unit to said upper case of the canister;

a purge control valve mounted to a hose extending from said gas outlet nipple toward a suction manifold of an engine, said valve being controlled by an engine control unit.

* * * * *